US005920754A

United States Patent [19]

Chung et al.

[11] Patent Number: 5,920,754

[45] Date of Patent: Jul. 6, 1999

[54] DOCTOR BLADE GAP ADJUSTING SYSTEM FOR ELECTROPHOTOGRAPHIC PROCESSOR

[75] Inventors: Su-Jong Chung; Hyun-Ju Seo, both of Suwon, Rep. of Korea

[73] Assignee: SamSung Electronics Co., Ltd., Kyungki-do, Rep. of Korea

[21] Appl. No.: 08/761,508

[22] Filed: Dec. 6, 1996

[30] Foreign Application Priority Data

Dec. 13, 1995 [KR] Rep. of Korea ..... 40828/1995

[51] Int. Cl.[6] ..... G03G 15/04

[52] U.S. Cl. ..... 399/119; 399/274; 399/284

[58] Field of Search ..... 399/107, 110, 399/119, 222, 265, 274, 279, 284

[56] References Cited

U.S. PATENT DOCUMENTS

| | | | |
|---|---|---|---|
| 3,942,474 | 3/1976 | Smith et al. | 399/119 |
| 4,378,753 | 4/1983 | Ueno et al. | 399/274 X |
| 4,579,081 | 4/1986 | Kohyama | 399/119 |
| 4,616,918 | 10/1986 | Kohyama et al. | 399/284 |
| 4,695,153 | 9/1987 | Matsushita | 399/274 |
| 5,085,171 | 2/1992 | Aulick et al. . | |
| 5,134,960 | 8/1992 | Shirai | 399/284 X |
| 5,191,170 | 3/1993 | Yoshida et al. . | |
| 5,210,575 | 5/1993 | Kikuchi . | |
| 5,278,616 | 1/1994 | Hirano et al. . | |
| 5,303,010 | 4/1994 | Takano et al. . | |
| 5,338,895 | 8/1994 | Ikegawa et al. . | |
| 5,404,211 | 4/1995 | Hashimoto et al. . | |
| 5,499,082 | 3/1996 | Watanabe et al. | 399/274 |
| 5,548,386 | 8/1996 | Fukuda . | |

*Primary Examiner*—Sandra Brase
*Attorney, Agent, or Firm*—Robert E. Bushnell, Esq.

[57] ABSTRACT

A developing unit for an electrophotographic processor includes a developing roller and a doctor blade for controlling an amount of developing material on an outer surface of the developing roller. A developer housing stores the developing material and has an opening for accommodating installation of the developing roller. First and second arm plates are connected to first and second ends of the developer housing, respectively. The first and second arm plates each have an eye into which the developing roller is inserted. First and second protrusions extend outwardly from the first and second arm plates, respectively, and provide surfaces upon which the doctor blade is placed during assembly of the developing unit to ensure a uniform spacial gap between the outer surface of the developing roller and an edge of the doctor blade.

20 Claims, 3 Drawing Sheets

DOCTOR BLADE GAP ADJUSTING SYSTEM FOR ELECTROPHOTOGRAPHIC PROCESSOR

CROSS-REFERENCE TO RELATED APPLICATIONS

This application makes reference to, incorporates the same herein, and claims all benefits accruing under 35 U.S.C. §119 arising from an application for Doctor Blade Gap Adjusting System For Electrophotographic Processor earlier filed in the Korean Industrial Property Office on Dec. 13, 1995 and there duly assigned Serial No. 40828/1995.

BACKGROUND OF THE INVENTION

The present invention relates to an electrophotographic processor, such as a laser beam printer, a xerographic copier, a facsimile unit, etc., and more particularly, to a system for maintaining a uniform spacial gap between a developing roller and a doctor blade in an electrophotographic processor without using a thickness gauge.

In an electrophotographic image forming process, toner is charged and brought into contact with the surface of a rotating developing roller which carries the toner into contact with a photoconductive drum. The developing roller is semiconductive and charged to a potential between that on the toner and that on charged areas of the photoconductive drum. As the developing roller rotates, toner is attracted to an outer surface of the developing roller from a supply source of the toner.

When the developing roller surface has left contact with the toner supply and is rotating towards a nip contact with the surface of the photoconductive drum, it encounters a doctor blade which limits toner to a controlled, thin layer on the developing roller. U.S. Pat. No. 5,085,171 entitled Compliant Doctor Blade issued to Aulick et al. discloses a conventional design for a developing roller and doctor blade. In Aulick et al. '171, the doctor blade has an outer metal surface on a grit layer with flexible backing. The doctor blade is pushed by foam, or alternatively, by inherent resilience, onto an outer surface of the developing roller. This compliance reduces toner variations which result from surface variations of the doctor blade and the developing roller. While conventional art, such as Aulick et al. '171, provides benefits in its own right, I note that it fails to adequately provide a structure that facilitates assembly while concomitantly maintaining a uniform spacial gap between the doctor blade and the developing roller.

SUMMARY OF THE INVENTION

Accordingly, it is an object of the present invention to provide a doctor blade gap adjusting system for an electrophotographic processor which can maintain a uniform spacial gap between a doctor blade and a developing roller.

It is another object to provide a doctor blade gap adjusting system for an electrophotographic processor which can be manufactured through standard fabricating steps and enhance manufacturing productivity.

It is still another object to provide a doctor blade gap adjusting system for an electrophotographic processor which regulates a gap between a doctor blade and a developing roller by the use of specialized arm plates.

It is yet another object to provide a doctor blade gap adjusting system for an electrophotographic processor that prevents deformation of a gap between a doctor blade and a developing roller, even after the doctor blade and developing roller have sustained substantial use.

To achieve these and other objects, the present invention provides a developing unit for an electrophotographic processor including a developing roller and a doctor blade for controlling an amount of developing material on an outer surface of the developing roller. A developer housing stores the developing material and has an opening for accommodating installation of the developing roller. First and second arm plates are connected to first and second ends of the developer housing, respectively. The first and second arm plates each have an eye into which the developing roller is inserted. First and second protrusions extend outwardly from the first and second arm plates, respectively, and provide surfaces upon which the doctor blade is placed during assembly of the developing unit to ensure a uniform spacial gap between the outer surface of the developing roller and an edge of the doctor blade.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, wherein.

DETAILED DESCRIPTION OF THE INVENTION

Figure 1:
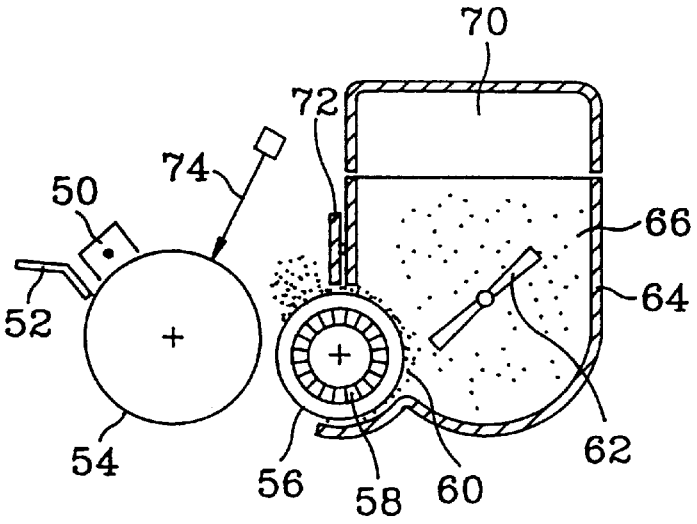
FIG. 1 is a side view of an image forming system for an electrophotographic processor.

Turning now to the drawings and referring to FIG. 1, a side view of an image forming system for an electrophotographic processor is shown. In FIG. 1, when toner 66 is supplied from a toner loader 70, the toner 66 is stirred by an agitator 62 and provided to a developing sleeve 56. The toner 66 is blended with a carrier 60 on the developing sleeve 56 and charged to a predetermined polarity by friction. The developer (i.e., toner 66 and carrier 60) is attached to the surface of the developing sleeve 56, and transmitted to a photoconductive drum 54 by the magnetic force of a magnetic roller 58. A doctor blade 72 is spaced-apart from an upper portion of the developing sleeve 56 to ensure that the developer is uniformly applied to the photoconductive drum 54. Doctor blade 72 is connected to a housing 64, and extends vertically over a center line of the developing sleeve 56. When light 74 from a laser scanner unit is scanned upon the uniformly charged surface of the photoconductive drum 54, an electrostatic latent image is formed on the scanned area of the photoconductive drum 54.

While the application of developer is regulated by doctor blade 72, the electrostatic latent image on photoconductive drum 54 is converted into a toner image. This toner image is transferred to a printable medium, such as paper, as the printable medium passes between the photoconductive drum 54 and a transfer unit. The printable medium is then transferred to a fixing unit where the toner image is permanently fixed to the printable medium. Finally, the printable medium is expelled from the interior of the electrophotographic processor, and delivered into a tray. The electrostatic latent image and residual toner are removed from the outer surface of the photoconductive drum 54 by an erasing unit 50 and a cleaner 52, respectively.

Figure 2:
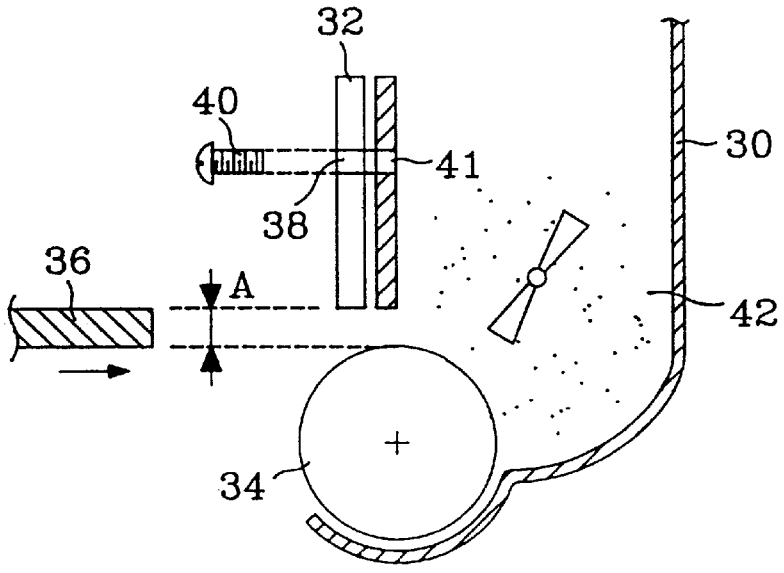
FIG. 2 is a side view of a doctor blade gap adjusting system for an electrophotographic processor.

FIG. 2 is a side view of a doctor blade gap adjusting system for an electrophotographic processor. In FIG. 2, a developer housing 30 accommodates a developing roller 34 that provides electrically charged toner 42 to a photoconductive drum to convert an electrostatic latent image formed on the outer surface of the photoconductive drum into a toner image. A doctor blade 32 is disposed over the developing roller 34 to ensure that the toner 42 is uniformly applied to the developing roller 34. A screw hole 38 is formed in the doctor blade 32 so that the doctor blade 32 can be connected to the developer housing 30 via a screw 40. A hole 41 is also formed in one sidewall of the developer housing 30 to accommodate the connection between doctor blade 32 and developer housing 30. When the doctor blade 32 is connected to developer housing 30, a thickness gauge 36 is used to maintain a gap A between the doctor blade 32 and the outer surface of developing roller 34.

Operation of the doctor blade gap adjusting system of FIG. 2 will now be described.

In order to maintain the gap A between the developing roller 34 and doctor blade 32, the thickness gauge 36 is immovably disposed on the developing roller 34, and the doctor blade 36 is placed on the thickness gage 36. After aligning the screw hole 38 in the doctor blade 32 with the hole 41 in the developer housing 30, the screw 40 is used to firmly fasten the doctor blade 32 to the developer housing 30. Once the doctor blade 32 is connected to developer housing 30, the gap A can be maintained by withdrawing the thickness gauge 36 from between the developing roller 34 and doctor blade 32.

According to this technique, the gap A varies based on the magnitude of force used in pressing the doctor blade 32 downwardly when the doctor blade 32 is fastened to developer housing 30 with the screw 40. Moreover, the gap A can become uneven due to the torque generated when screwing the screw 40 into holes 38 and 41. The doctor blade 32 is generally constructed from a mold. Therefore, the size of the gap A changes due to thermal deformation and residual stress that occurs when the doctor blade 32 is used. Also, since the thickness gauge 36 is used to maintain the gap A, the number of fabricating steps increases, thereby lowering manufacturing productivity.

Figure 3:
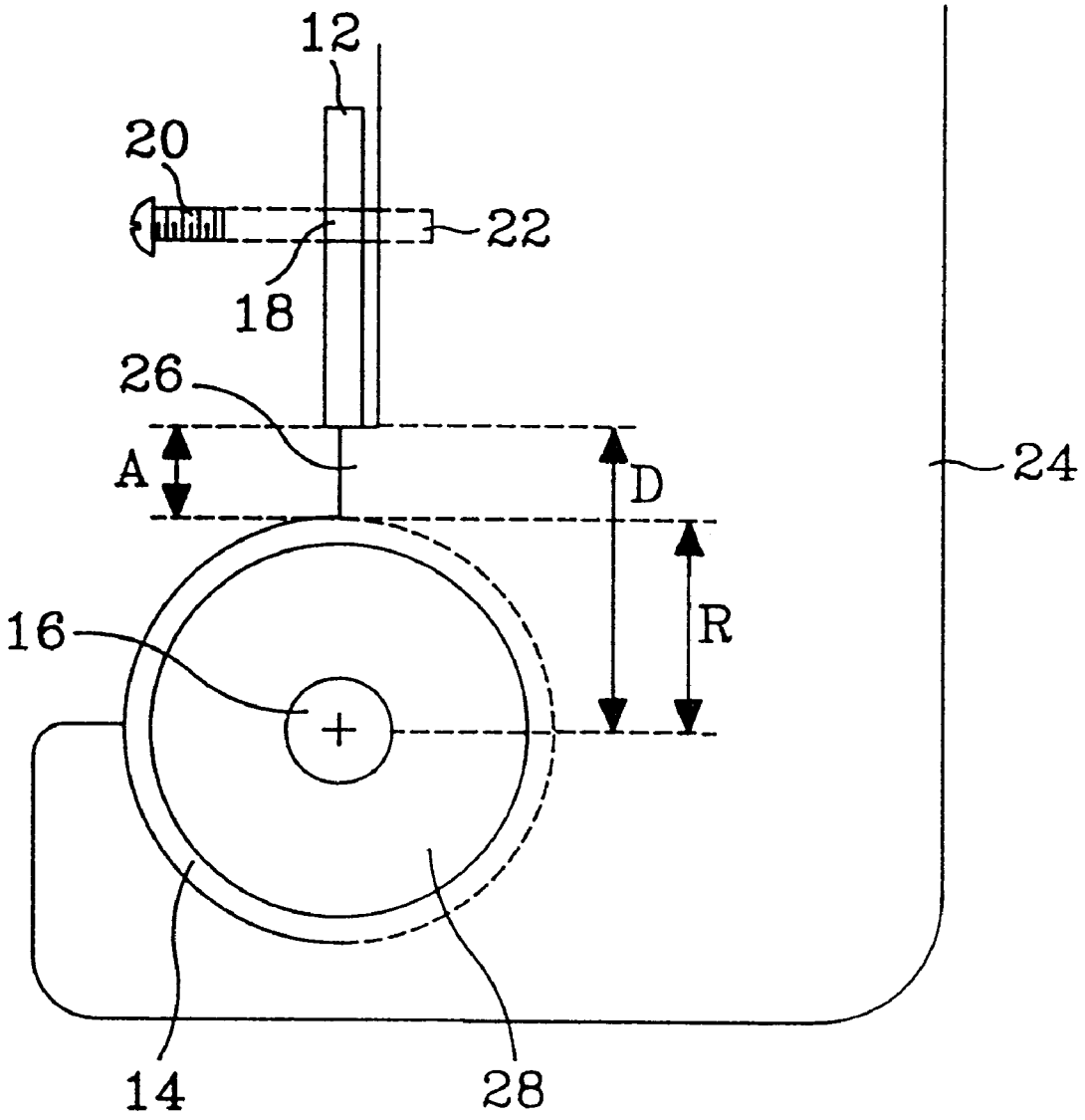
FIG. 3 is a side view of a doctor blade gap adjusting system for an electrophotographic processor in accordance with the principles of the present invention.
Figure 4:
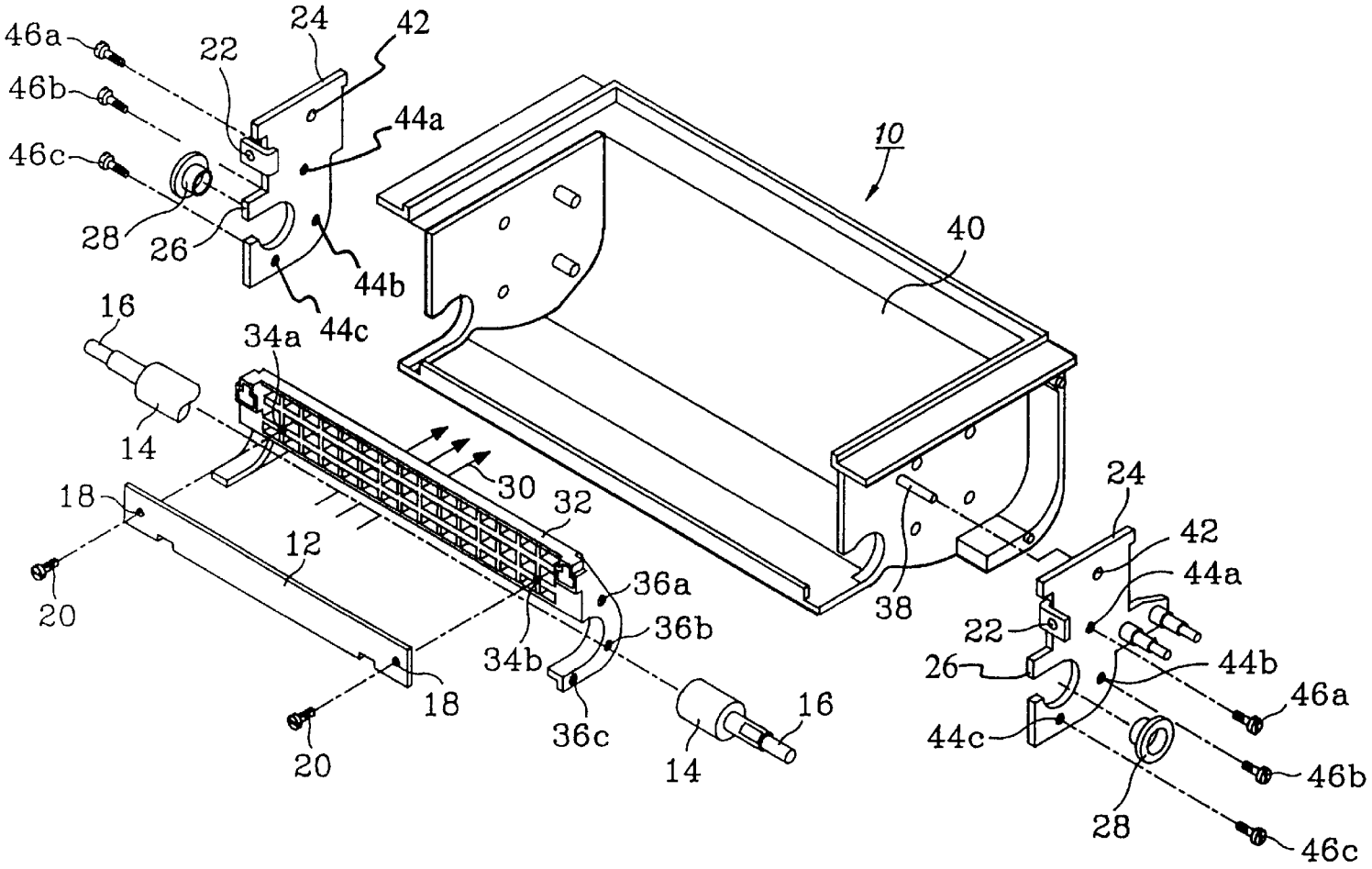
FIG. 4 is an exploded perspective view of a developing unit in accordance with the principles of the present invention.

FIG. 3 is a side view of a doctor blade gap adjusting system for an electrophotographic processor in accordance with the principles of the present invention, and FIG. 4 is an exploded perspective view of a developing unit in accordance with the principles of the present invention. A preferred embodiment of the present invention will now be described in detail with reference to FIGS. 3 and 4. Note that these figures may not necessarily be drawn to scale.

A developer housing 10 for storing developing material includes a main housing 40 and a side housing 32. Main housing 40, which actually stores the developing material, has no sidewall on a side to which a developing roller 14 is provided. The side housing 32 closes the side of the main housing 40 that is without a sidewall, and accommodates the developing roller 14 to form an opening 30 together with the main housing 40. Developing roller 14 rotates upon shafts 16 that extend outwardly from the developing roller 14 on both sides.

The developer housing 10 is divided into two parts in a preferred embodiment of the present invention, although the developer housing 10 can exist as a unitary structure. Shafts 38 are formed on both sides of main housing 40. The shafts 38 are fitted into holes 42 formed in upper portions of arm plates 24, and serve as reference points for positioning the arm plates 24. Each arm plate 24 is constructed from a metallic material, and includes a protrusion 26 that enables proper installation of a doctor blade 12.

The side housing 32 is interposed between the arm plates 24, and is fastened to the main housing 40 by the use of screws to form the opening 30. Holes 36*a*, 36*b* and 36*c* are formed on one side of the side housing 32, and are designed to correspond to holes 44*a*, 44*b* and 44*c* formed in each of the arm plates 24. Side housing 32 is connected to the arm plates 24 by the use of screws 46*a*, 46*b* and 46*c*. When assembling the arm plates 24, the developing roller 14 is inserted into the opening 30 of the developer housing 10 and fitted into the eyes of the arm plates 24 with bearings 28 for rotation. Each eye may be designed to be open on one side. The developing roller 14, bearings 28, side housing 32 and arm plates 24 are firmly fastened to each other through the above steps.

The doctor blade 12 is positioned on the protrusions 26 of the respective arm plates 24. Holes 18 are formed in doctor blade 12, and holes 34*a* and 34*b* are formed in side housing 32 to enable a connection between the doctor blade 12 and side housing 32 via screws 20. Arm plates 24 each include another hole 22 on a flange 23, existing in the same horizontal plane as holes 34*a* and 34*b*. According to an alternative construction, the doctor blade 12 can be connected to arm plates 24 via holes 22.

A method for regulating a gap A between the doctor blade 12 and an outer surface of the developing roller 14 will now be described with reference to FIG. 3.

The gap A is formed by engaging the doctor blade 12 with upper portions of the respective arm plates 24, and placing the doctor blade 12 to rest upon protrusions 26. The doctor blade 12 is then connected to the side housing 32 via screws 20 (or alternatively, to arm plates 24). As indicated in FIG. 3, the gap A is equal to a distance D minus a distance R. The distance D extends from a center of the shaft 16 of developing roller 14 to the bottom of doctor blade 12. In other words, the distance D extends from a center of the eye of the arm plate 24 to the top of the protrusion 26. The distance R represents a radius of the developing roller 14. Accordingly, the gap A can be expressed as follows:

$$A=D-R$$

The gap A may be created provided that proper management as to the tolerance on the bearing 28, developing roller 14 and arm plates 24 is carried out.

With the doctor blade gap adjusting system of the present invention, to maintain a desired gap between the doctor blade 12 and developing roller 14, the doctor blade 12 is placed upon the protrusions 26 of the respective arm plates 24 so that the gap can be free from deformation. Since the doctor blade 12 is immovably disposed on the upper portions of the arm plates 24, the gap is never changed by pressing forces. Accordingly, there is no deviation created based on working skill so that standard operations are applicable. Moreover, the present invention prevents deformations of the gap caused by torques, and enables manufacture with a reduced number of steps.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A developing unit for an electrophotographic processor, comprising:

a developing roller;

a doctor blade for controlling an amount of developing material on an outer surface of said developing roller;

a developer housing for storing the developing material and having an opening for accommodating installation of said developing roller;

first and second arm plates connectable to first and second ends of said developer housing, respectively, said first and second arm plates each having an eye into which said developing roller is inserted; and first and second protrusions extending outwardly from said first and second arm plates, respectively, and providing surfaces upon which said doctor blade is placed during assembly of said developing unit to ensure a uniform spacial gap between the outer surface of said developing roller and an edge of said doctor blade.

2. The developing unit according to claim 1, wherein said developer housing further comprises a side housing connected within the opening for accommodating installation of said developing roller.

3. The developing unit according to claim 2, further comprised of said first and second arm plates each being composed of a metallic material.

4. The developing unit according to claim 3, further comprised of said first and second arm plates being respectively connected to said first and second ends of said developer housing via screws.

5. The developing unit according to claim 1, further comprised of said first and second arm plates each being composed of a metallic material.

6. The developing unit according to claim 1, further comprised of said first and second arm plates being respectively connected to said first and second ends of said developer housing via screws.

7. The developing unit according to claim 1, wherein the gap between the outer surface of said developing roller and the edge of said doctor blade is defined by a first distance minus a second distance, said first distance extending from a center of said developing roller to the surfaces provided by said first and second protrusions, said second distance equaling a radius of said developing roller.

8. A developing unit for an electrophotographic processor, comprising:

a developing roller;

a doctor blade for controlling an amount of developing material on an outer surface of said developing roller;

a developer housing for storing the developing material and providing the developing material to said developing roller;

first and second arm plates connectable to first and second ends of said developer housing, respectively, said first and second arm plates each having an eye into which said developing roller is inserted; and first and second protrusions extending outwardly from said first and second arm plates, respectively, and providing surfaces upon which said doctor blade is placed during assembly of said developing unit to ensure a uniform spacial gap between the outer surface of said developing roller and an edge of said doctor blade.

9. The developing unit according to claim 8, further comprised of said first and second arm plates each being composed of a metallic material.

10. The developing unit according to claim 9, further comprised of said first and second arm plates being respectively connected to said first and second ends of said developer housing via screws.

11. The developing unit according to claim 10, wherein the gap between the outer surface of said developing roller and the edge of said doctor blade is defined by a first distance minus a second distance, said first distance extending from a center of said developing roller to the surfaces provided by said first and second protrusions, said second distance equaling a radius of said developing roller.

12. The developing unit according to claim 8, further comprised of said first and second arm plates being respectively connected to said first and second ends of said developer housing via screws.

13. The developing unit according to claim 8, wherein the gap between the outer surface of said developing roller and the edge of said doctor blade is defined by a first distance minus a second distance, said first distance extending from a center of said developing roller to the surfaces provided by said first and second protrusions, said second distance equaling a radius of said developing roller.

14. A method for assembling a developing unit of an electrophotographic processor, comprising the steps of:

connecting first and second arm plates to first and second ends of a housing;

inserting a developing roller into an opening formed by said housing; and positioning a doctor blade upon first and second protrusions that extend outwardly from said first and second arm plates, respectively, to form a uniform spacial gap between an outer surface of said developing roller and an edge of said doctor blade.

15. The method according to claim 14, further comprised of connecting said doctor blade to said housing after said doctor blade is positioned upon said first and second protrusions.

16. The method according to claim 14, further comprised of connecting first and second ends of said doctor blade to said first and second arm plates, respectively, after said doctor blade is positioned upon said first and second protrusions.

17. A developing unit for an electrophotographic processor, comprising:

a developing roller;

a doctor blade for controlling an amount of developing material on an outer surface of said developing roller;

a developer housing comprised of a main housing and a side housing for storing the developing material and having an opening for accommodating installation of said developing roller;

first and second arm plates connected to first and second ends of said developer housing, respectively, said first and second arm plates each having an eye into which said developing roller is inserted, said first and second arm plates each having a protrusion extending outward;

a flange attached to each of said first and second arm plates, said flange oriented perpendicularly to said protrusion extending outward from each of said first and second arm plates;

said side housing attachable to two oppositely aligned ends of said main housing between said main housing and said first and second arm plates; and said doctor blade resting upon said protrusion on said first and second arm plate to ensure a uniform spacial gap between the outer surface of said developing roller and an edge of said doctor blade.

18. The developing unit according to claim 17, further comprised of said first and second arm plates being composed of a metallic material.

19. The developing unit according to claim 17, further comprised of said first and second arm plates being connected to oppositely aligned distal ends of said developing unit and said side housing using a fastener.

20. The developing unit according to claim 19, with said fastener being any one of a bolt, rivet, screw, and clamp.

* * * * *